United States Patent [19]

Hwang

[11] Patent Number: 4,871,172

[45] Date of Patent: Oct. 3, 1989

[54] PLAYING RULES FOR LOTTERY-LIKE GAME

[76] Inventor: Cheng-Hsuon Hwang, No. 2078, Tong Men Market 2nd Floor, Hsinchu City, Taiwan

[21] Appl. No.: 193,535

[22] Filed: May 11, 1988

[51] Int. Cl.[4] ..... A63F 3/06

[52] U.S. Cl. ..... 273/138 R; 283/903

[58] Field of Search ..... 273/138 R, 138 A, 139, 273/148 R; 283/903

[56] References Cited

U.S. PATENT DOCUMENTS

| | | | |
|---|---|---|---|
| 4,191,376 | 3/1980 | Goldman et al. | 273/139 |
| 4,591,190 | 5/1986 | Clark | 273/139 X |
| 4,725,079 | 2/1988 | Koza et al. | 273/139 X |

FOREIGN PATENT DOCUMENTS

| | | | |
|---|---|---|---|
| 2063688 | 6/1981 | United Kingdom | 273/138 R |

OTHER PUBLICATIONS

"Scarne's New Complete Guide to Gambling" by John Scarne, publ. by Simon & Schuster, N.Y., copyright 1974, pp. 174–181.

*Primary Examiner*—Anton O. Oechsle

[57] ABSTRACT

The present disclosure is related to a simple rule for playing a lottery-like game and the distribution of the bonus to the winners. Each ticket is comprised of a major number and a sub-number. The major number consists of more than 5 digits and the last 2 or 3 consecutive digits of the major number of the ticket are used to form the sub-number which is distinguishingly indicated by a special mark. Near the sub-number, the rules for checking the sub-manner with a particular winning major number and the times of award with respect to the ticket price are clearly illustracted. A certain amount of tickets having an identical major number are grouped together as a set. Each set consists of a certain amount of tickets having a 2-digit sub-number and the rest of the tickets in the set are 3-digit sub-number. 6 winning major numbers for publicly announced prizes, and each ticket holder has to check his or her ticket's major number with the major numbers and the sub-number with an accordingly specified winning number or numbers. The bonus for the winners of sub-numbers takes 40% of the total of the awards in the game. In such a manner, the participants of the game can enjoy more freedom to select the way of playing the game and find more fun and excitement and fairness therein.

7 Claims, 2 Drawing Sheets

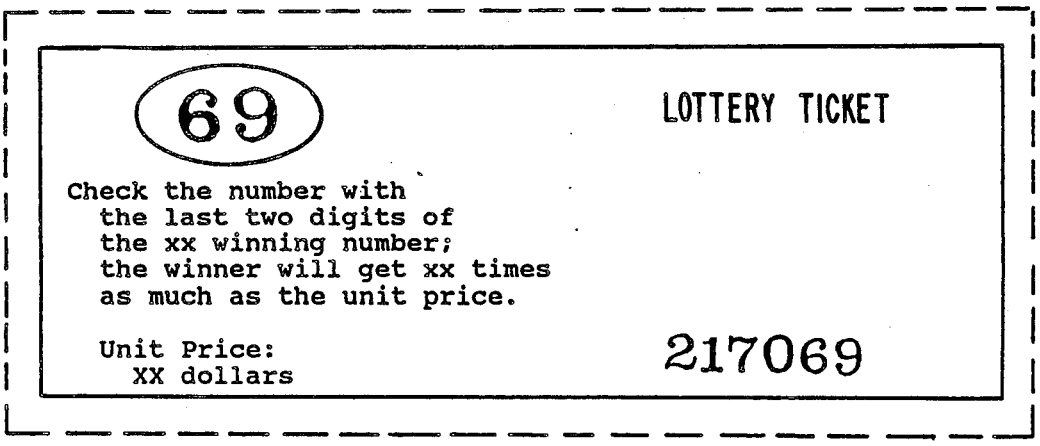

FIG. 1

69

LOTTERY TICKET

Check the number with
the last two digits of
the xx winning number;
the winner will get xx times
as much as the unit price.

Unit Price:
XX dollars

217069

FIG. 2

069

LOTTERY TICKET

Check the number with
the last three digits of:
1. the xx winning number, the winner gets xx times as much as the unit price.
2. the xx winning number, the winer gets xx times as much as the unit price.

Unit Price:
XX dollars

217069

FIG. 3

| | | |
|---|---|---|
| (-) | Ticket Selling: | One number ticket is issued in ten-unit groups, each unit ticket is sold at xx dollars, the ten-unit tickets can be sold separately as a whole. |
| (=) | Reward: | The reward is given on the basis of ten-unit group. |
| | Special reward: | For one number; the grouped ten-unit tickets are awarded with XX dollars together. |
| | First reward: | For one number; the grouped ten-unit tickets are awarded with XX dollars together. |
| | Second reward: | For two numbers; the grouped ten-unit tickets are awarded with XX dollars together. |
| | Third reward: | For twenty numbers; the grouped ten-unit tickets are awarded with twenty thousand dollars together. |
| | Fourth reward: | For thirty numbers; the grouped ten-unit tickets are awarded with ten thousand dollars together. |

PLAYING RULES FOR LOTTERY-LIKE GAME

BACKGROUND OF THE INVENTION

1. Field of the Invention

The present invention provides simple rules for a lottery-like game in which each ticket-holder can enjoy a more reasonable chance of winning a prize. In the game, each ticket is given a major number consisting of more than 5 digits and a specially indicated sub-number having 2 or 3 digits taken from the end of the major number. Both of the numbers are available for checking with the announced winning numbers so that the chance of winning a prize is doubled, thus offering people a more rewarding and exciting game thereby.

2. The Prior Art

In most of the prior lottery games, each ticket is usually assigned only with a number which is checked with several formally publicly announced numbers consisting of different number of digits, and the large, intermediate and small prizes are given to those ticket holders when their tickets have the identical numbers in accordance with the announced numbers. The disadvantage of these kinds of gambling rules stems from the fact that the chances of winning big prizes are very small; although the chances of winning small prizes are enhanced, the awards of them are relatively small as a result of the wide allocation of the sum of the awards; moreover, the ticket holders do not have much freedom to choose the favorable numbers on the tickets to improve their chances of winning reasonable awards. Therefore, such games are not able to fully meet the requirements of most of the ticket holders, and the winning chances are not satisfactorily good to attract more people to invest their money therein.

SUMMARY OF THE INVENTION

The primary object of the present invention is to provide simple rules for a lottery-like game wherein each ticket is assigned with a major number and a sub-number; the major number consists of more than 5 digits, and the sub-number is formed by taking the last 2 or 3 digits from the major number. A group of interlined tickets having an identical major number are regarded as a set which includes a number of tickets having a two-digit sub-number and the rest of the tickets in the set having three-digit sub-number. Thus people can choose tickets in accordance with their favorable numbers either for major numbers or sub-numbers; and the winners are those ticket holders whose tickets have matched with the formally-announced major numbers, or their sub-numbers are in agreement with the last two or three digits of the declared major numbers, and prizes of different levels are awarded to those winning ticket holders. In such a manner, the chance of winning a prize is greatly enhanced, and more reasonable awards are given to the participants, making the game have more fun and exciting than ever.

BRIEF DESCRIPTION OF THE DRAWINGS

To make the features and the rules of play according to the present invention more understandable, a number of drawings are provided along with a detailed description of the preferred embodiment, in which FIG. 1 is a diagram showing a ticket of the present invention having a 2 - digit subnumber in addition to its 6 - digit major number.

FIG. 2 is a diagram showing a ticket of the present invention having a 3 - digit subnumber in addition to its 6 - digit major number.

FIG. 3 is a diagram showing the back side of a ticket of the present invention illustrating the rules of the present game thereon.

DETAILED DESCRIPTION OF THE PREFERRED EMBODIMENT

Referring first to FIG. 1 through FIG. 3, five tickets having an identical major number are grouped together as a set in this embodiment; alternatively, 6, 8, 10 or more tickets are also able to be grouped together as one set. The number of digits that each major number contains is determined by the tickets issued. Each ticket has a major number consisting of 6 digits, preferably through either less or more digits may be used for the major numbers. A sub-number, in enlargement, taken from the last two or three digits of the major number, is outstandingly circled on the ticket by any kind of mark such as an oval or the like. In each set containing a group of identically numbered tickets, a certain portion are assigned with a 2-digit sub-number and the rest are given a 3-digit sub-number. The proportion of the distribution of such tickets is variable, depending on practical requirements.

On the back of each ticket, the rules of the present game and the amount of award for each winning prize concerning the match of the major number are expressly stated; whereas the front side of the ticket is provided with the statement for the ticket of the multiple of the purchase price of the ticket which will be avoided if the sub-number in coincidence with the last two or three digits of the specified winning major number. The specified two or three digits of each ticket are enlarged and encircled in an oval on the front of the ticket for the buyers' choice. Which winning major number is specified for the match with the selected two or three digits of the ticket sub-number is clearly shown on the front of the ticket for person's choice.

For example, if the sub-number of a ticket consisting of two digits, is expressly limited on the front statement to only compare with the last two digits of the second winning major number, the ticket holder can be awarded only with the condition met, i.e., the subnumber of his ticket matches the last two or three digits of the major number picked for the second reward (see FIG. 3), and he or she can obtain an award, for example, of 15 times as much of the sale price of the ticket. Another case, the front statement requires that the ticket, having a 3-digit sub-number, be checked with the winning major number of the first prize, whereby the ticket holder of the winning number can get an award of 300 times as much as the sale price of the ticket.

It can be expressly stated on the front of a ticket that the sub-number of a ticket is also permitted to be checked with the last two or three digits of more than one winning major number. For example, if the sub-number of a ticket is in agreement with the last two digits of the second winning major number, each ticket holder can get an award of 10 times as much as the ticket price; and if the sub-number is checked with the last two digits of any of the special or first winning major numbers, the ticket holder can get an award of 5 times as much as the ticket price. As may be shown on the front of a ticket, if a sub-number consisting of 3 digits is in agreement with the last three consecutive digits of the special winning major number the award will be 210 times as much as the ticket price; if it is checked with the last three consecutive digits of any one of the first and second winning major numbers, the award will be 30 times as much as the ticket price.

In the case that the two-digit sub-number of the ticket is in coincident agreement with that of more than two winning major numbers, the award will be the total of each individual award. Of course, the award for each winning ticket in the same set having a identical major number is the same. It is now apparent that the game provides the ticket holder with more freedom to make his choice and introduces more fun and expectation into the game.

The detailed rules of the present game are summarized as follows:

A. Each ticket is given a major number consisting of more than 5 digits and a sub-number including 2 or 3 digits taken from the last two or three consecutive digits of the major number thereof, and the sub-number is particularly enlarged and circled by a specific mark. Near the surrounded sub-number, the winning major numbers to be checked and the awards thereof are listed.

B. The awards for the winners whose tickets have winning sub-numbers are different from level to level, depending on the amount of the total awards given.

C. In each set consisting of a number of tickets with an identical major number, the proportion of tickets having 2-digit sub-numbers and 3-digit sub-numbers therein are selectively variable.

D. The total of the awards for the winners with matched sub-number tickets takes 40% of the sum of the bonus each time, and the rest is for the tickets having winning major numbers.

E. The sponsor of the present game has only to draw out the major numbers of the winning tickets without particularly setting up for the winning sub-numbers.

F. The ticket holders have to check the major numbers of their tickets with the announced winning major numbers first, and then the sub-numbers with the specified winning major number to see if awards are acquired.

It becomes clear that the present rules of playing the lottery-like game introduce more fun and freedom for choice therein and make expectation of weaving reasonably increased. Therefore more excitement and amusement are readily created, and more people are attracted to take part in the present game.

What I claim is:

1. A system for playing a lottery-like game comprising: a number of tickets for sale, each ticket having a major number with at least 5 digits and a sub-number containing 2 or 3 consecutive digits of the major number of the ticket, a set of the tickets comprising a collection of tickets having an identical major number, each ticket having printed thereon the sub-number which is enlarged to an extent and distinguishingly circled by a particular mark for each selection by a buyer wherein near each circled sub-number specifications for matching the sub-number and awards for a winning sub-number are expressly listed and whereby each ticket in the game can have a substantially doubled chance to win a reasonable prize by providing awards for the major number as well as the sub-number.

2. A system for playing a lottery-like game as claimed in claim 1, wherein the number of tickets in each set is variably determined by a sponsor issuing the tickets, and the ratio of the tickets containing 2 digits to those containing 3 digits in each set is also variably changed and wherein the sub-number is restrained by a clear rule shown on each ticket to be matched with a particularly assigned winning major number or several winning numbers.

3. A system for playing a lottery-like game as claimed in claim 2, wherein the award for each winning ticket in the same set having an identical major number is the same, whereas, the awards for the winning sub-numbers having 2-digits and 3-digits are different and the award for each winning sub-number with 2-digits or 3-digits can be in a multi-prize form.

4. A system for playing a lottery-like game as claimed in claim 2, wherein the sum of the award for all the winning sub-numbers takes more than 40% of the total award of the game, and the rest of the award is for the ticket holders of the tickets of winning major numbers.

5. An apparatus for playing a lottery-like game comprising a plurality of tickets for sale to purchasers, each ticket having a major number with at least 5 digits and a sub-number of two or three consecutive digits of the major numbers, said plurality comprising at least one set of tickets, each ticket in the set having the same major number and each set having a number of tickets having a two digit sub-number and a number of tickets having a three digit sub-number, wherein the sub-number is printed on each ticket in an enlarged form, separate from the major number and wherein each ticket includes, printed thereon, specification of prizes to be awarded to tickets having sub-numbers matching the sub-numbers of at least one winning ticket, whereby each ticket has an increased chance of winning an award by having a matching major number and a winning sub-number.

6. A process of playing a lottery-like game comprising the steps of:

providing a plurality of tickets, each ticket having a major number of at least five digits and a sub-number of two or three consecutive digits of the major number, said plurality consisting of a plurality of sets of tickets, each ticket in the set having an identical major number and each set having a number of tickets having a two-digit sub-number and a number of tickets having a three digit sub-number;

selling the tickets to purchasers;

selecting at least one winning ticket; and awarding prizes to purchasers having tickets whose major numbers and/or sub-numbers match major numbers and/or subnumbers of the at least one winning ticket.

7. A process for playing according to claim 6, wherein said step of providing comprises the steps of:

determining the number of tickets in each set;

determining the number of tickets having two digit sub-numbers and the number having three digit sub-numbers in each set; and determining with which winning number of the at least one winning number the sub-number on each ticket is to be matched.

* * * * *